US005620582A

United States Patent [19]

Lerner

[11] Patent Number: 5,620,582

[45] Date of Patent: Apr. 15, 1997

[54] ENERGY-SAVING PROCESS FOR ARCHITECTURAL ANODIZING

[76] Inventor: Moisey M. Lerner, 75 Rolling La., Needham, Mass. 02192

[21] Appl. No.: 459,517

[22] Filed: Jun. 2, 1995

[51] Int. Cl.[6] ..... C25D 11/04

[52] U.S. Cl. ..... 205/107; 204/228; 205/106

[58] Field of Search ..... 205/106, 107, 205/108; 204/228

[56] References Cited

U.S. PATENT DOCUMENTS

| | | | |
|---|---|---|---|
| 4,115,211 | 9/1978 | Tsukamoto et al. | 205/106 |
| 4,128,461 | 12/1978 | Lerner et al. | 205/106 |
| 4,133,725 | 1/1979 | Lerner et al. | 205/106 |
| 4,170,739 | 10/1979 | Frusztajer et al. | 307/2 |
| 4,331,524 | 5/1982 | Matthes | 204/129.95 |
| 5,271,818 | 12/1993 | Strosynski et al. | 204/211 |

*Primary Examiner*—Kathryn L. Gorgos

*Assistant Examiner*—William T. Leader

*Attorney, Agent, or Firm*—Tomin Corporation

[57] ABSTRACT

A method for low-voltage architectural anodizing of aluminum and aluminum alloy articles by using a direct anodizing current ranging for different machines from 10 kA up to 50 kA and more, plus a superimposed alternating current of industrial frequency. The combination of DC and AC reduces the DC voltage component across the tank to less than 10 VDC thus cutting the power consumption in the tank to half of the usual consumption in the straight DC anodizing. The resonant DC+AC power supply to feed the architectural anodizing machine is derived from the power supply claimed in the U.S. Pat. No. 4,170,739, by employing three one-phase transformers instead of one three-phase transformer, and three one-phase saturable core reactors instead of one three-phase saturable core reactor as a voltage control device. Magnetic cores of all transformers and saturable core reactors are therefore decoupled making it possible to supply the tank with the required level of the direct current component.

9 Claims, 4 Drawing Sheets

ENERGY-SAVING PROCESS FOR ARCHITECTURAL ANODIZING

FIELD OF THE INVENTION

The invention relates to processes and means for low-voltage anodizing aluminum and aluminum alloys. More particularly the invention relates to a low-voltage process of architectural anodizing in a water solution of sulfuric acid and to a machine to do the same.

BACKGROUND OF THE INVENTION

Anodizing of aluminum for architectural purposes is a high-energy-consuming process. A typical architectural anodizing machine requires tens of kilo-amperes. Ordinarily, an anodizing run in a water solution of sulfuric acid at room temperature lasts 25 min to form a 10-micron-coating on aluminum, or 50 min for a 20-micron-coating. Following Faraday's Law, the current density in these conditions does not exceed 1–1.5 A/dm$^2$ for different aluminum alloy compositions.

Said range of current densities can be achieved using a DC power supply with the voltage control from 0 to 17–25 VDC. Experience shows that within this voltage range the heat dissipation in the oxide film is still below the level causing catastrophic dissolution of the oxide film and of the aluminum it covers. This catastrophic dissolution is often called "burning". Without the danger of burning, the air agitation of tank electrolyte may be moderate. Besides, no reduction of electrolyte temperature below the room temperature level is needed.

An oxide film formed in these conditions is rather soft—it can easily be scratched. The film is porous, and therefore it can be used as a base to hold coloring agents. A coloring agent can be either an organic dye introduced into the coating by an additional process, or an inorganic substance introduced into the coating at the second step of the architectural anodizing process known as a "two-step" process.

On a much smaller scale, when current consumption is below the 10 kA level, a process analogous to the architectural anodizing described above is called "conventional" anodizing process.

Another kind of coating, called "hard coating" is formed in a water solution of sulfuric acid at higher current densities: over 2 A/dm$^2$ versus 1–1.5 A/dm$^2$ in conventional or architectural anodizing. Hard coating has a sapphire, or close to it, hardness that distinguishes this coating from a much softer "conventional" coating. Typically, the hard-coating process forms thicknesses in excess of 50 microns which are often used to change dimensions of aluminum articles. A hard-coating run may last 40 minutes and more, depending on required thickness. A hard-coating process is conducted at much higher voltages than in conventional anodizing. The voltage can reach 70 VDC and more. Multiplying this voltage by the current density of 2 A/dm$^2$ and more, we arrive at power levels that dramatically exceed the power spent in conventional anodizing.

The electric power sent to a hard-coating tank dissipates mostly in the oxide film formed on aluminum articles. To prevent "burning", the air agitation of the electrolyte must be vigorous and the electrolyte temperature must be dropped to 0° C. and below. A typical hard-coating machine requires hundreds amperes to several kilo-amperes depending on productivity of the machine. A 5,000 A machine that consumes up to 350–500 kW is a rather rare occasion in hard-coating.

Besides the straight DC voltage, a hard-coating process can use DC voltage with a superimposed AC voltage (DC+AC voltage). This process was invented by Campbell and is described in the British Patent 716,554. The electrical power supply should provide for the superimposition of alternating and direct currents, usually up to 100 volts each, in order to form hard surface layers up to 250 microns. The current density is recommended to maintain at above 5 A/dm$^2$ and may be reduced toward the end of the process to improve adhesion.

The ability of using lower DC voltage component levels during hard-coating by DC+AC voltage was discovered by Lerner et al. and described in the U.S. Pat. No. 4,128,461. In the initial period of 1 to 8 minutes the DC voltage component is raised to about 10 volts and then is raised at a rate of about ½ volt per minute to a level within the range of 14 to 19 volts. Upon reaching that level, the DC and AC voltage components are held constant for a dwell period of at least 5 minutes, and then raised again for the remainder of the first hour up to 30, 40 or 50 volts.

Hard-coating by DC+AC can be conducted even at lower DC voltage levels. The final DC voltage component may be in the range from 14 to 80 volts as it was described in the U.S. Pat. No. 4,133,725 by Lerner et al.

A circuit for producing a DC voltage with superimposed AC voltage of industrial frequency is described in the U.S. Pat. No. 4,170,739 by Fruzstajer and Lerner. As illustrated in FIG. 1, the patent teaches to use in a DC+AC power supply a single phase or a multiphase transformer primary (23) of which is coupled with suitable voltage control device (22) such as saturable core reactor, semiconductor control rectifier, or autotransformer. Secondary (24) of the transformer has two types of windings: ordinary and unbalancing windings. All these windings are star-connected. An ordinary winding is used exclusively for supplying AC voltage to system (25) of rectifying circuit elements, whereas an unbalancing winding is used mainly for supplying an to unbalancing AC voltage to terminals (27 and 28) of load First load terminal (27) is connected to a system of rectifying circuit elements (25) and second load terminal (28) is connected to the unbalancing winding of the transformer so that a DC voltage component plus an AC voltage component are provided across the load. The maximum of the AC voltage is achieved when the second load terminal is moved away from the central point of the transformer secondary and connected to another end of the unbalancing winding. The wave-form of the AC component becomes close to sinusoidal with the help of coupling capacitor (29) connected between first load terminal (27) and the central point of the transformer secondary.

More specifically, the patented DC+AC power supply in the preferred embodiment is an unbalanced three-phase non-linear circuit with a floating center point in the primary of a three-phase transformer. The Y-connected windings of the transformer secondary coupled with diodes and with specifically connected capacitor generates DC voltage with a super-imposed close-to-sinusoidal AC voltage. This DC+AC voltage is supplied to aluminum articles which are a combination of resistive and capacitive loads. Said combination changes its parameters during the anodizing run. The circuit is self-controlling: as the oxide film builds up and its capacitive resistance and the active resistance to the current increases, the voltages across the transformer windings in the primary and in the secondary are automatically changed so that the DC voltage component across the tank gradually increases and the current through the tank gradually decreases. The degree of the voltage increase and of the current decrease depends on the composition of the aluminum alloy and on the concentration and the temperature of the electrolyte.

The larger the DC current output of the DC+AC power supply, the larger the power that dissipates in the tank while forming the oxide film on aluminum articles. 3000 A of direct current component at 15–20 VDC would generate about 60 kW of heat in the tank.

It was discovered from practice that the patented schematic has a threshold of about 100 kW beyond which it becomes very difficult to provide the needed DC output and the reliable operation of the power transformer without overheating it. Therefore, the circuitry taught by said patent is not feasible for manufacturing DC+AC power supplies for tens of kilo-amperes needed for architectural anodizing which demands dissipation of up to 500 kW and more in the anodizing tank.

Returning now to the straight DC architectural anodizing, I will estimate energy consumption during this process in a water solution of sulfuric acid. I will consider a rather habitual example of a 20,000-ampere-architectural-anodizing machine which is fed by a DC power supply that controls the voltage in the 0 to 25 VDC range. The process is conducted at a room temperature. We will assume that the average voltage during a run equals 20 VDC. Energy consumption for a 22-hour-day is equal to $$20\ V*20{,}000\ A*22\ hr=8{,}800\ kWhr$$

A chiller, needed to maintain room temperature of the tank electrolyte, consumes about a quarter of the energy spent on anodizing, or 2800 kWhr. Total energy consumption during a day then equals 11,000 kWhr. Annual energy consumption (250 days) equals 2,750,000 kWhr at a cost of over $400,000 if we assume the $0.15/kWhr rate.

Architectural anodizing in organic acids, such as sulphosalicylic acid, needs twice or thrice higher voltage levels than in conventional anodizing. It means that the energy cost increases proportionally.

SUMMARY OF THE INVENTION

In brief, the present invention provides a method for architectural anodizing of aluminum and aluminum alloy articles by using direct anodizing current with a superimposed alternating current of industrial frequency. The amplitude of the AC component is equal or higher than the DC component. This combination of DC and AC in architectural anodizing makes it possible to reduce the level of needed DC voltage component to less than 10 VDC compared to 80 VDC, on average, in the straight DC process. Therefore, the power consumption is at least twice lower than that in the DC architectural anodizing process, providing savings of $800,000 per year for a 80,000 A-machine operating 22 hours per day.

The additional AC component that flows with the DC component through a tank generates heat that is negligible in comparison with the energy generated by the DC component:

The AC component is not active—it flows through electrolytic capacitor which is created by an anodized aluminum article covered with the oxide-film-dielectric-material immersed in the anodizing tank. Therefore, the product of alternating current by AC voltage across the tank is mostly capacitive (not active) power.

It is only the drop of the AC voltage across the electrolyte that is active and generates heat. Ordinarily this drop does not exceed 1–1.5 V, and the active power is therefore less than one tenth of the power generated by the DC voltage component.

It is known that porosity of the oxide film on aluminum is inversely proportional to the DC anodizing voltage. It means that the oxide film formed by the DC voltage component below 10 VDC is at least twice more porous than the film formed at 80 VDC. More porosity provides more room for a dyeing substance to fill. Therefore, one needs less coating thickness formed by the novel process in order to yield the same rich color as the color of a thicker coating formed by the conventional architectural anodizing process. The lesser thickness means even lesser energy spent to form the coating and additional savings in energy costs.

The novel process can also form integral color coating by varying either the coating thickness, or the current density during the run, or the electrolyte temperature. The thicker the coating, and the higher the current density, and the lower the electrolyte temperature—the more intensive the integral color. Integral color also substantially depends on the composition of the aluminum alloy. Conventional anodizing, on the other hand, has a very limited ability to create an integral color coating.

In order to supply the architectural anodizing machine with a DC component ranging for different machines from 10 kA up to 50 kA and more, plus a close-to-sinusoidal alternating current component of about the same magnitude, a novel power supply is used. The present invention is distinguished by employing three one-phase-transformers instead of one three-phase-transformer in a schematic similar to that described in the U.S. Pat. No. 4,170,739 and depicted in FIG. 1. Primary windings of these three transformers are Y- or Δ-connected, and secondary windings are Y-connected (star-connected). Magnetic cores of all three transformers are therefore decoupled and the level of the DC current component sent to the tank becomes much higher compared to that of the prior art circuitry.

BRIEF DESCRIPTION OF THE DRAWINGS

This invention will be more fully understood from the following detailed description and the accompanying drawings, in which.

DETAILED DESCRIPTION OF THE INVENTION

Figure 2:
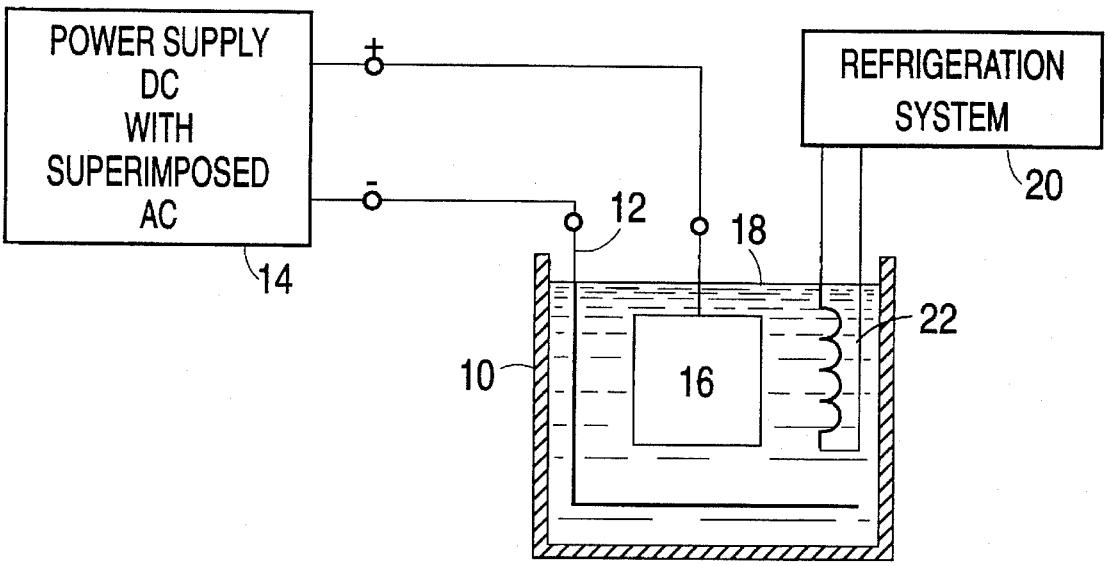
FIG. 2 is a diagrammatic representation of a machine for practicing the invention.

The aluminum articles to be anodized are immersed in the electrolytic bath and connected to the anodizing power supply. A machine for practicing the novel process is shown schematically in FIG. 2 and includes tank 10 containing electrolyte 18 and having immersed therein cathode 12 connected to the negative terminal of power supply 14 which provides a DC voltage with superimposed AC voltage. The other, positive, terminal of power supply 14 is connected to one or more articles 16 immersed in electrolyte 18 and which are to be anodized. Electrolyte 18 is a water solution of strong acids which partially dissolve the oxide film simultaneously with its formation. Such "strong acids" include sulfuric acid, chromic acid, oxalic acid, etc. (see U.S. Pat. No. 4,133,725, page 1, lines 35–39). Chiller 20 is provided and includes coils 22 in electrolyte 18 for maintaining the electrolytic bath at a predetermined temperature. In the actual implementation, the apparatus can be of many different well-known forms. Tank 10 can itself be of suitable metal to serve as the cathode, rather than employing a separate electrode in the bath.

In preferred embodiment, electrolyte 18 is an aqueous solution of 66° Baume sulfuric acid with a concentration of about 5.7–23% by volume. The electrolyte is kept at room temperature or below it by chiller 20. The electrolyte may be cooled by any known means such as by circulation of a refrigerating liquid through coils 22 or circulation of the electrolyte itself through a refrigeration system and returning to the tank after having been cooled.

Power supply 14 provides a DC voltage with a superimposed AC voltage the AC voltage component preferably being sinusoidal and of the industrial frequency of 50 to 60 Hz. The power supply terminal connected to articles 16 being anodized is positive with respect to the power supply terminal connected to the counter-electrode which is negative. Preferably, but not necessarily, the peak-to-peak value of the AC voltage component is twice the value of the DC voltage component.

Supplying the architectural anodizing machine with a DC component ranging for different machines from 10 kA up to 50 kA and more cannot be done with the help of the prior art circuitry claimed in the the U.S. Pat. No. 4,170,739. A threshold of about 100 kW of tank power is observed in practicing this art. This threshold would limit the current to not more than 10 kA at 10 VDC and makes the prior art DC+AC power source infeasible for supplying the demanded DC for architectural anodizing.

Figure 1:
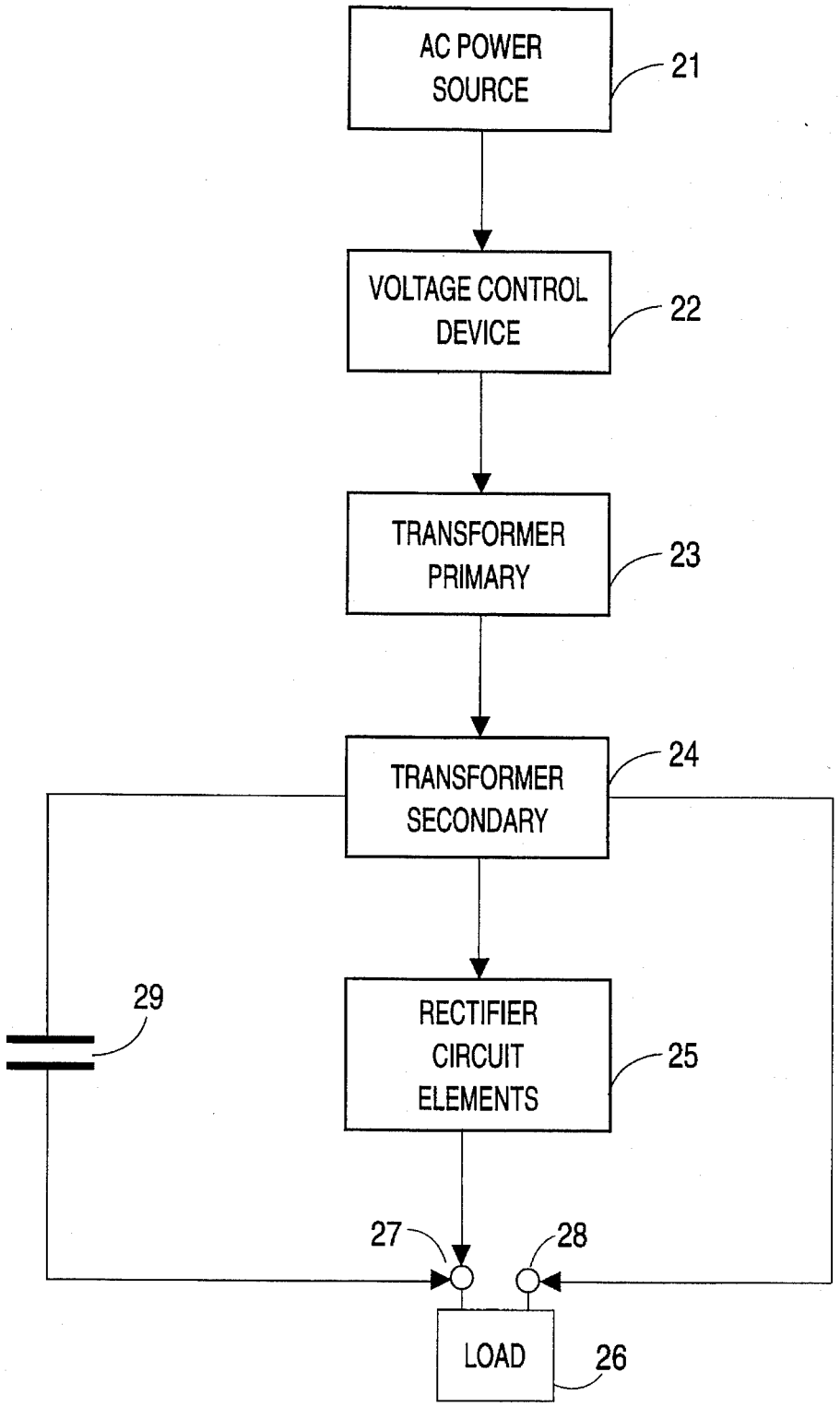
FIG. 1 is a schematic block diagram which illustrates the prior art method and system for providing an AC voltage superimposed on a DC voltage across a load.

I discovered that said threshold was caused by failure of the prior art to recognize that modifying one of the ordinary windings of secondary (24) in FIG. 1 so that it becomes an unbalancing winding, and adding a capacitor between load terminal (27) and common point of all windings, creates a novel type of power supply. An ordinary winding transforms into unbalancing winding by moving load terminal (28) from the common point of all windings to the other end of formerly "ordinary" winding. The novel power supply requires a specific circuitry foreign to one used in power supplies in which all windings are ordinary. I will call hereinafter this novel type of power source as a "resonant" power supply. It supplies to a load a DC component plus a close-to-sinusoidal AC component of industrial frequency at resonance conditions in the circuitry.

Physically, in a resonant power source the energy supplied from the electric power station is stored during part of the cycle in the magnetic field of the transformer and of the saturable core reactor. A quarter cycle later this energy is stored in the electric field of the capacitors of the device and in the electrolytic capacitor created by the oxide film formed on aluminum articles in the tank. In another quarter of cycle it is once again stored in the magnetic field of the transformer and reactor. Thus, energy is transferred back and forth between inductive elements and capacitive elements of the circuit. At resonances the only net energy supplied to the circuit is that dissipated as heat in the tank causing the oxide film to form on the surface of aluminum articles. This net energy (about 20% of the total power of the system) is recorded by a kWhr-meter. This is the energy which is paid for. The rest of the energy is conserved changing from magnetic to electrical state and vice versa without affecting the readings of the kWhr-meter.

The further the circuit from the resonance the higher the additional energy (inductive or capacitive) which is supplied from the electric power station to the circuit. However, the energy recorded by the kWhr-meter remains the same—it equals the energy spent on the formation of the oxide film in the tank by the DC component.

Figure 3:
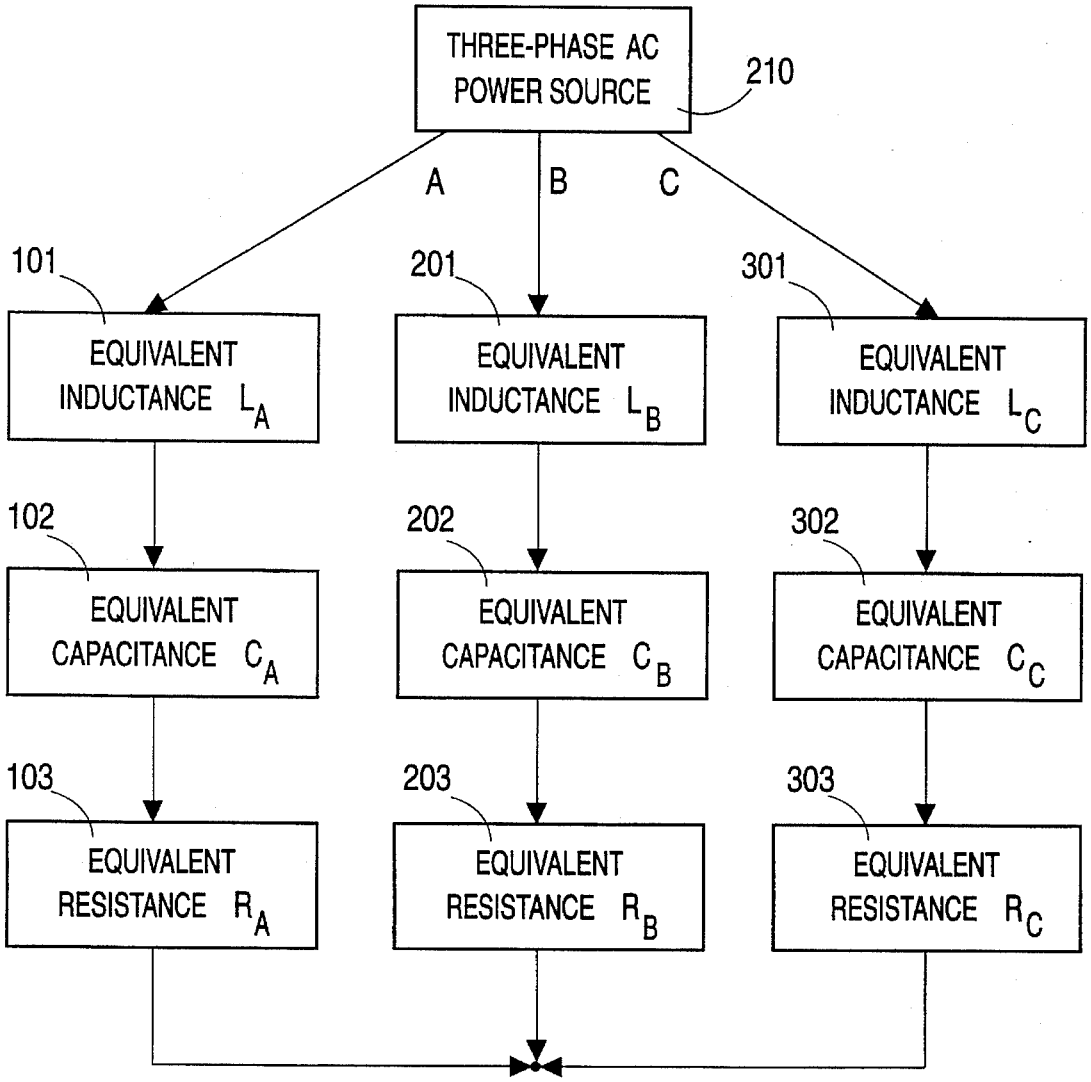
FIG. 3 is an equivalent schematic that reflects the close-to-resonance physical processes occurring in the DC+AC power supply and in the load.

FIG. 3 is an equivalent schematic which illustrates the conditions for resonance in a resonant power supply including one described in FIG. 1. This equivalent schematic has an inductive $L_A$ element (101), a capacitive $C_A$ element (102) and an equivalent resistive $R_a$ element (103) in phase A. Correspondingly elements (201), (202), and (203) are in phase B and elements (301), (302), and (303)—in phase C. All these elements are equivalently representing the real elements of the primary and of the secondary of the power supply and of the load. $L_A$, $L_B$, and $L_C$ reflect the inductance of saturable core reactors and transformers. $C_A$, $C_B$, and $C_C$ reflect the capacitance of power source capacitors and of the load. $R_A$, $R_B$, and $R_A$ reflect the heat dissipation which occurs predominantly in the load.

When the inductive resistance becomes equal to the capacitive resistance in a phase then a resonance is observed in this phase. However, resonance is not the ultimate goal of the DC+AC power supply—it is rather a means for achieving the real goal which is the required level of the DC component in the tank. Direct current is the only factor responsible for creating a coating according to Faraday's Law, all other factors such as the resonance and the AC component help to obtain the required DC component at the lowest level of the DC voltage component. The resonant DC+AC power supply works acceptably well if the DC power dissipated in the tank does not drop much below the 20% level of the total power of the power supply. We will call this requirement hereinafter as the "20%-power-rule".

In order to achieve a three-phase resonance, the resonance conditions should be established in each phase. This means that the equivalent inductive resistance in each phase must be close to the equivalent capacitive resistance of the same phase. This requirement should be achieved at any power level. At the same time the 20%-power-rule requirement should also be met.

However, the prior art circuitry failed to achieve these conditions beyond the 0.5 MVA level of oscillating power. At this level, the net power dissipated in the tank is below 100 kW, or no more than 10,000 A of direct current at 10 VDC. This threshold is caused by a strong interdependence of inductive elements in each phase because the phase windings are coupled by a single core of the three-phase transformer taught by the prior patent. Even if just two of the three windings were coupled by a common core, still a strong interdependence between magnetic elements of the two phases of the power supply exists. This interdependence can ruin once achieved balance of inductive and capacitive resistances in a particular phase due to the influence of processes occurring in another phase. Besides impairing the three-phase resonance, this interdependence also limits the level of the direct current that the system yields to the tank. Moreover, since the DC component in the secondary windings located on a common core of a single transformer may become non-compensated, this direct current can shift the working point of the magnetic curve closer to its non-linear segment, thus causing an increase in losses in the transformer core. This would bring about overheating and failure of the transformer. The probability of overheating increases with the increase of the transformer power, thus creating the mentioned above threshold for practical implementation of the prior art circuitry.

Figure 4:
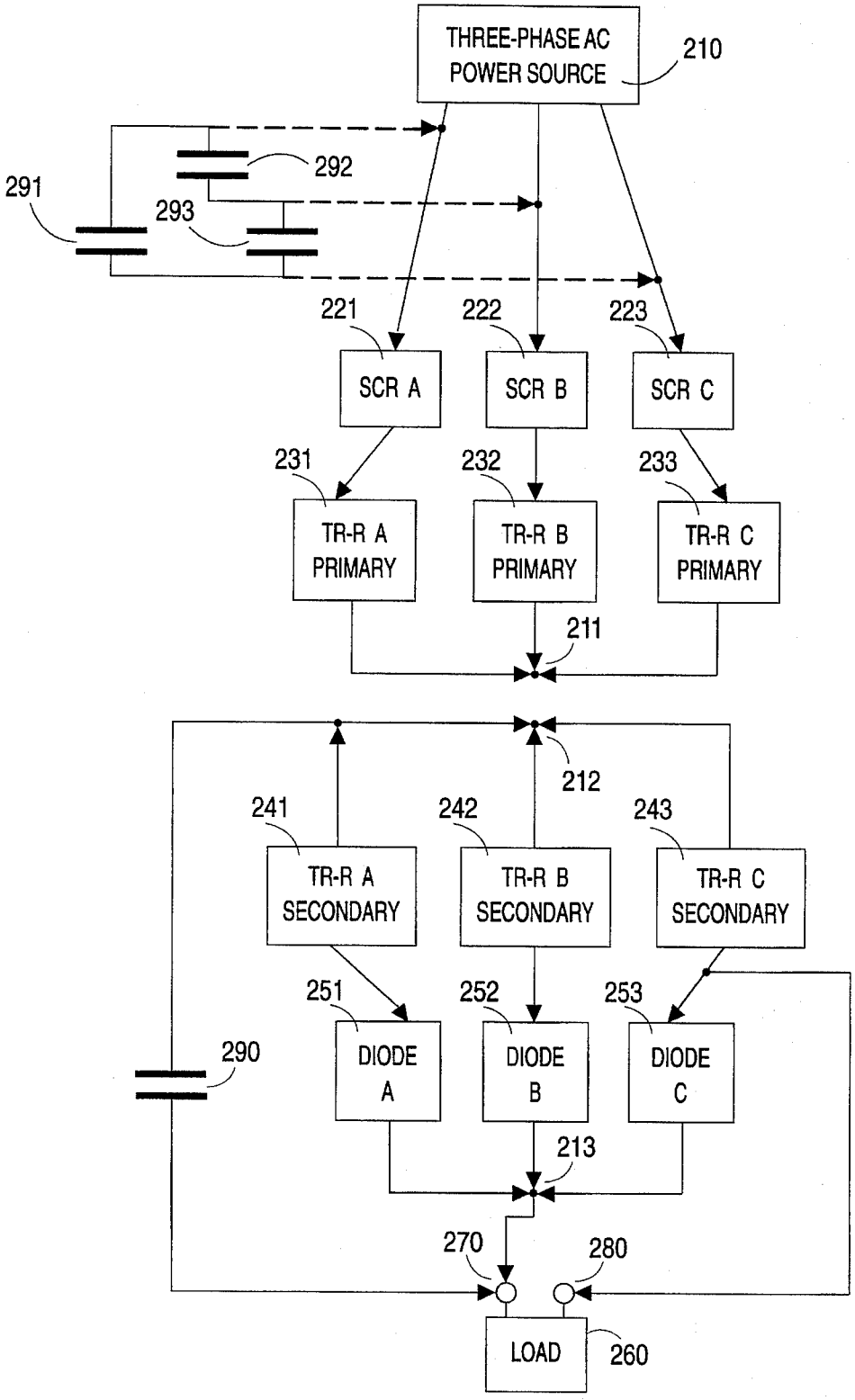
FIG. 4 is a schematic block diagram which illustrates the invented method and system for providing an AC voltage superimposed on a DC voltage across the load.

The preferred embodiment of the present invention is depicted in FIG. 4. It is a three-phase system where a sine-form voltage of industrial frequency, predominantly of 60 or 50 cycles per second, is applied from source (210) to three individual one-phase transformers. Their primary windings (231), (232) and (233) are Y-connected having a common point (211). Each transformer is coupled with a voltage control element which is saturable core reactor (221), or (222), or (223). The Δ-connection of the primary windings can also be employed since the source appears to be more evenly current loaded. The secondary phase windings of individual transformers, namely (241), (242) and (243) are Y-connected (star connected) in point (212). Windings (241) and (242) are ordinary windings and are used exclusively for supplying voltage to rectifier circuit elements (251) and (252), both elements being connected to common point (213) and having the positive direction with respect to this point.

Decoupling of magnetic fields of ordinary windings goes against the practice of designing conventional power supplies: coupling the ordinary windings with the help of a common core is a must in order to compensate the constant magnetic fluxes induced by the DC current component in each of the ordinary winding. Decoupling of the ordinary windings is a peculiar novelty of the resonant DC+AC power supplies which reflects the specific philosophy of designing said power sources.

Winding (243), which is also decoupled, is an unbalancing winding and is used predominantly for supplying voltage to change AC potential of second terminal (280) of load (260). First load terminal (270) is connected to common point (213) rectifying circuit elements (251), (252) and (253). The waveform of the AC component across load (260) becomes close to sinusoidal with the help of coupling capacitor (290) connected between first load terminal (270) and central point (212).

Since the main goal of the invented resonant DC+AC power source is to supply the anodizing tank with the required amount of direct current at a DC voltage level below 10 VDC, this goal may be achieved not exactly at resonance but at close-to-resonance conditions. Current demand from the electric power station will increase in this case because an additional non-compensated inductive power need to flow to and from the system wasting a part of current carrying capacity of the electric power line. In order to compensate this current, power correction capacitors (291), (292) and (293) should be added as illustrated in FIG. 4. These capacitors are connected to phases A, B and C by dotted lines. It is preferred to be able to control the level of added capacitive power while the energy consumption in the tank changes.

What is claimed is:

1. A method for architectural anodizing at least one aluminum or aluminum alloy article comprising the steps of:

immersing said article in an electrolyte composed of an aqueous solution of an acid;

applying for a time interval across said article and a cathode a DC voltage component with a superimposed AC voltage component, the positive potential of the DC voltage component being applied to said article and the negative potential of the DC voltage component being applied to said cathode;

said DC voltage component having a value during at least a portion of said time interval substantially in the range of 6–10 volts, said value being the highest DC voltage applied during said time interval to said article, said DC voltage component with a superimposed AC voltage component being generated with three star-connected one-phase transformers, each transformer having a primary winding and a secondary winding, a first side of all secondary windings of said three one-phase transformers being star-connected to form a central point of secondary windings, and magnetic fields of said windings being decoupled, each field being enclosed in a magnetic core of its own transformer, each transformer being coupled with an individual voltage control device at a first side of the transformer primary winding, said voltage control device being a saturable core reactor, each transformer being connected with a rectifying circuit element at a second side of the transformer secondary winding, two of said three transformers having their secondary windings used exclusively for supplying voltage to said rectifying circuit elements, the first side of said windings being connected to the central point of secondary windings and the second side being connected only to the corresponding rectifying element, said windings being called ordinary windings, and for the secondary winding of the third transformer, the first side of said winding being connected to the central point of secondary windings and the second side being connected to the corresponding rectifying element and to said cathode as well, said winding being also used for supplying an AC voltage component to said aluminum article, said winding being called an unbalancing winding.

2. The method of claim 1 wherein said electrolyte is an aqueous solution of 5.7–23% by volume of 66° Baume sulfuric acid.

3. The method of claim 2 wherein said electrolyte is cooled to room temperature.

4. The method of claim 1 wherein said DC voltage component creates anodizing direct current density in the range of about 1 to 1.5 A/dm$^2$.

5. The method of claim 4 wherein total direct current through said articles with said current densities is in the range about 10 to 50 kilo-amperes.

6. The method of claim 1 wherein said time interval is greater than 10 minutes in duration and including the step of increasing the direct current density during the first 5–10 minutes of said time interval to a final level in the range of about 1–1.5 A/dm$^2$.

7. The method of claim 1 wherein each of said rectifying circuit elements has a first terminal and a second terminal, said first terminal being connected to said second side of each transformer secondary winding and said second terminal being connected to a common point, said AC voltage component across said aluminum article and the cathode being generated by connecting said article to the common point of the rectifying circuit elements, said common point having a positive DC potential in respect to said electrolyte, and by connecting said cathode to the second side of the unbalancing winding.

8. The method of claim 7 wherein said aluminum article being also connected to one terminal of a capacitor, the second terminal of said capacitor being connected to said central point of secondary windings.

9. A method for architectural anodizing at least one aluminum or aluminum alloy article comprising the steps of:

immersing said article in an electrolyte composed of an aqueous solution of an acid;

applying for a time interval across said article and a cathode a DC voltage component with a superimposed AC voltage component, the positive potential of the DC voltage component being applied to said article and the negative potential of the DC voltage component being applied to said cathode;

said DC voltage component having a value during at least a portion of said time interval substantially in the range of 6–10 volts, said value being the highest DC voltage applied during said time interval to said article, said DC voltage component with a superimposed AC voltage component being generated with three star-connected one-phase transformers, each transformer having a primary winding and a secondary winding, a first side of all secondary windings of said three one-phase transformers being star-connected to form a central point of secondary windings, and magnetic fields of said windings being decoupled, each field being enclosed in a magnetic core of its own transformer, each transformer being coupled with an individual voltage control device at a first side of the transformer primary winding, said voltage control device being a saturable core reactor, each transformer being connected with a first terminal of a rectifying circuit element at a second side of the transformer secondary winding, a second terminal of each rectifying circuit element being connected to a common point, two of said three transformers having their secondary windings used exclusively for supplying voltage to said rectifying circuit elements, the first side of said secondary windings being connected to the central point of secondary windings and the second side being connected only to the corresponding rectifying element, said windings being called ordinary windings, and for the secondary winding of the third transformer, the first side of said winding being connected to the central point of secondary windings and the second side being connected to the corresponding rectifying element and to said cathode as well, said winding being also used for supplying an AC voltage component to said aluminum article, said winding being called an unbalancing winding, said AC voltage component across said aluminum article and the cathode being generated by connecting said article to the common point of the rectifying circuit elements, said common point having a positive DC potential in respect to said electrolyte, and by connecting said cathode to the second side of the unbalancing winding, and said aluminum article being also connected to one terminal of a capacitor, the second terminal of said capacitor being connected to said central point of secondary windings.

* * * * *